United States Patent [19]

Kume et al.

[11] 4,299,180

[45] * Nov. 10, 1981

[54] ELECTRICAL AUTOMATIC PATTERN STITCHING SEWING MACHINE

[75] Inventors: Toshiaki Kume, Tachikawa; Toshihide Kakinuma, Tokyo; Hachiro Makabe, Fussa; Kazuo Watanabe; Hideaki Takenoya, both of Hachioji, all of Japan

[73] Assignee: Janome Sewing Machine Co., Ltd., Tokyo, Japan

[ * ] Notice: The portion of the term of this patent subsequent to Mar. 27, 1996, has been disclaimed.

[21] Appl. No.: 953,169

[22] Filed: Oct. 20, 1978

Related U.S. Application Data

[63] Continuation of Ser. No. 760,948, Jan. 21, 1977, Pat. No. 4,145,982.

[30] Foreign Application Priority Data

Jan. 22, 1976 [JP] Japan ..... 51-5421

[51] Int. Cl.[3] ..... D05B 3/02

[52] U.S. Cl. ..... 112/158 E

[58] Field of Search ..... 112/158 E, 121.11, 158 R, 112/121.12; 318/567, 569

[56] References Cited

U.S. PATENT DOCUMENTS 4,145,982 2/1979 Kume et al. ..... 112/158 E

*Primary Examiner*—Peter P. Nerbun

*Attorney, Agent, or Firm*—Michael J. Striker

[57] ABSTRACT

The needle-shifting zig-zag unit and the work feeding unit are moved to different positions, when necessary, for successive stitches, to form a stitching pattern. Each unit is powered by the main rotating drive shaft of the sewing machine. However, each unit is provided with a respective stepper motor. Each stepper motor changes the setting of an adjuster in a reciprocating-motion generator driven by the main drive shaft. When one of these adjusters is in a constant setting, its respective reciprocating-motion generator continually generates reciprocating motion of constant corresponding amplitude, for an unlimited time, so long as the drive shaft rotates. The needle-penetration coordinates for the stitching pattern are established by continually changing the amplitude of the reciprocations performed by the two reciprocating-motion generators. A static memory is read out, in synchronism with sewing, to furnish information commanding the stepper motors to move the amplitude adjusters of the reciprocating-motion generators from one amplitude setting to another, very quickly, to in this way establish all the successive needle-penetration coordinates for even complex stitching patterns.

4 Claims, 12 Drawing Figures

FIG_11-A
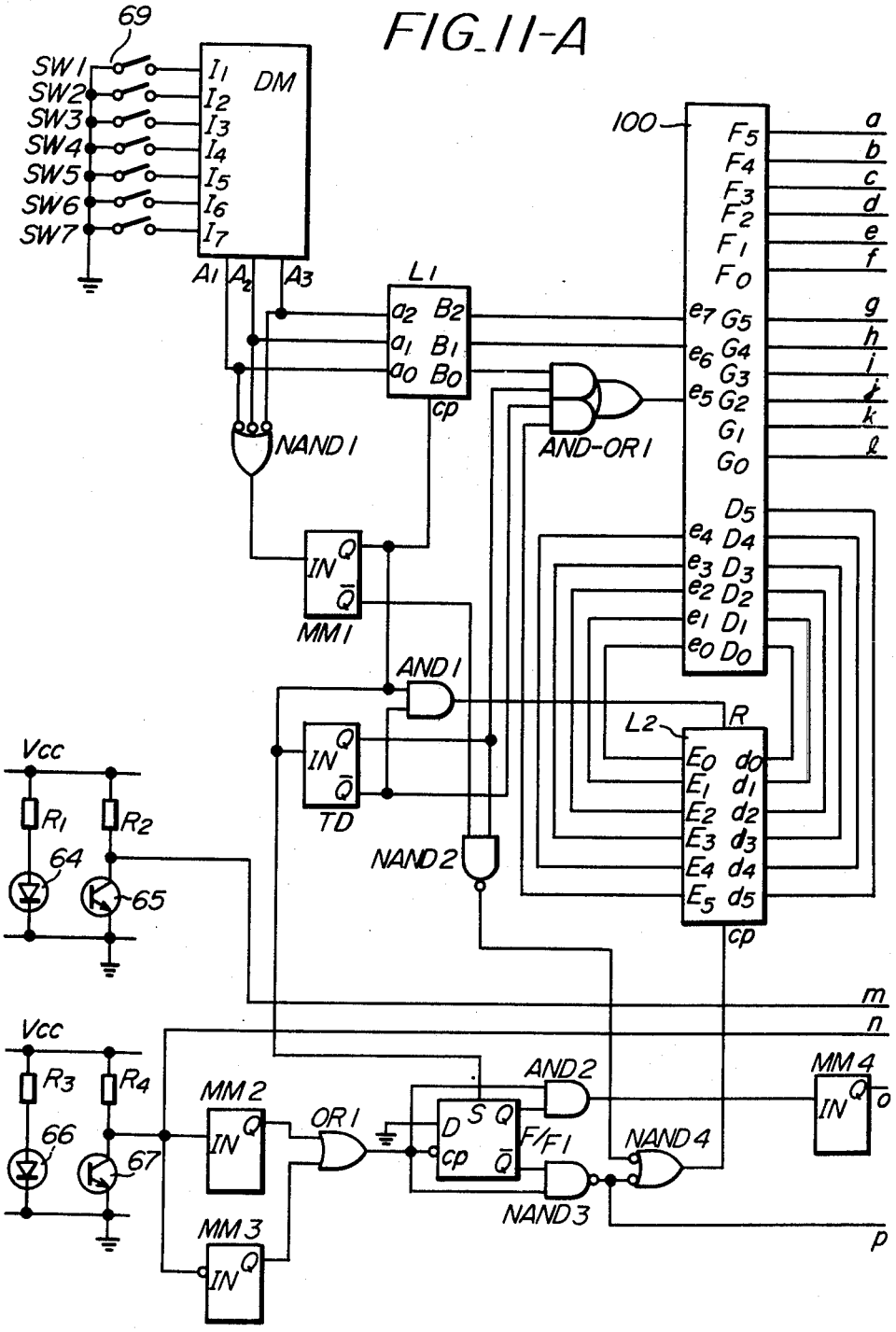

FIG_11-B
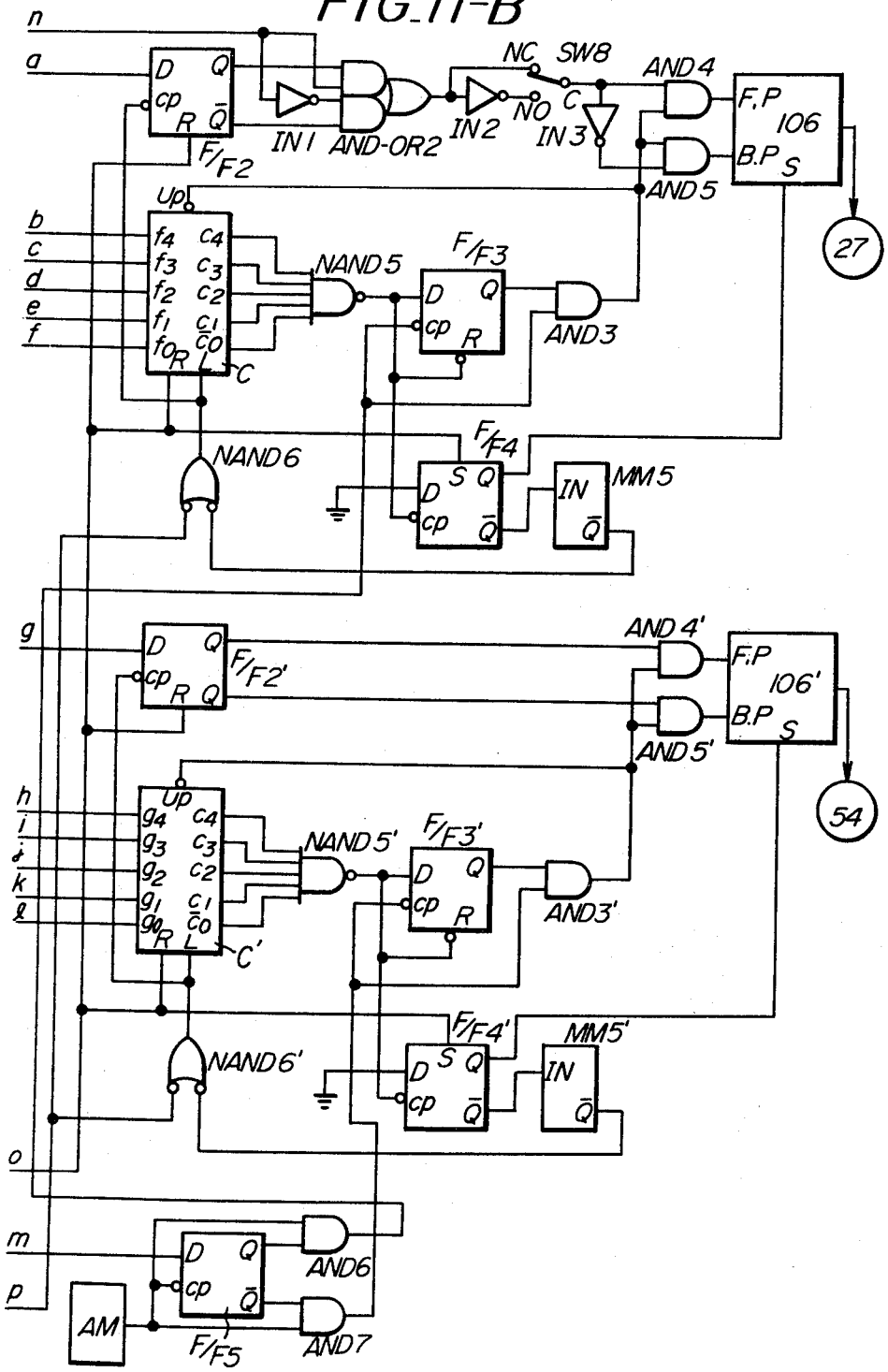

ELECTRICAL AUTOMATIC PATTERN STITCHING SEWING MACHINE

This is a continuation of application Ser. No. 760,948, filed Jan. 21, 1977.

The invention relates to an electrical automatic pattern stitching sewing machine, in which the stitch forming instrumentalties are electrically operated to change the position between the needle and the sewn cloth to form stitches in a pattern. Therefore this invention provides a sewing machine of simple structure producing a stabilized stitch formation.

According to the sewing machine of this invention, the needle mechanism and the feed mechanism are electrically and automatically controlled by stitch control signals memorized in a semi-conductor memory, and the mechanism for controlling and driving the needle bar and the feed mechanism are simplified in structure and operation. As a drive source of such mechanism, at least two reversible electric motors are provided, which are driven by pulse signals to cause the stitch forming instrumentalities to form stitches.

Thus inthis invention, a lot of patterns are provided in a limited space of the sewing machine, and the control mechanism of the stitch forming instrumentalities are smoothly and effectively operated, and accurate and stablilized stitches are obtained. Moreover, the operation of the sewing machine is simplified.

Heretofore there have been provided many controlling methods in which a pulse or stepper motor is driven by a signal to control the operations of the stitch forming instrumentalities to determine the stitch co-ordinates. However, in such methods, since the pulse motor directly controls the stitch forming instrumentalities comparatively large output motor is required and accordingly the motor is large sized in volume. Therefore it is difficult to install such a motor in a limited space of the sewing machine, and accordingly a considerable inertia grows in the associated mechanism, and it becomes difficult to determine the exact coordinates. Further, since the stitch control signals to the pulse motor were provided by the dynamic memories such as a mechanical memory, a magnetic tape, a perforated tape, etc., the whole control apparatus of the sewing machine becomes bulky and therefore the weight of the sewing machine becomes heavy.

The present invention has been devised to remove those shortcomings of the prior art.

It is a basic object of the invention to combine a swinging movement of a swinging member in a timed relation to the upper shaft of the sewing maching to the rotation of a pulse motor controlled by electric signals so that complicated patterns or turned over patterns may be easily obtained.

It is another object of the invention to employ a semiconductor memory, and accordingly a small sized pulse motor to reduce the inertia in the associated control mechanisms, so that the exact and stabilized stitch coordinates of patterns may be secured.

It is a further object of the invention to reduce abrasions, noises or vibrations of the associated control mechanisms by making small sized the drive source of such mechanisms.

Other features and advantages of the invention and the actual operations thereof will be apparent by the following explanations of the preferably embodiments with reference to the accompanying drawings, in which, FIG. 1 is a sewing machine according to the present invention.

DETAILED DESCRIPTION OF THE INVENTION

Figure 1:
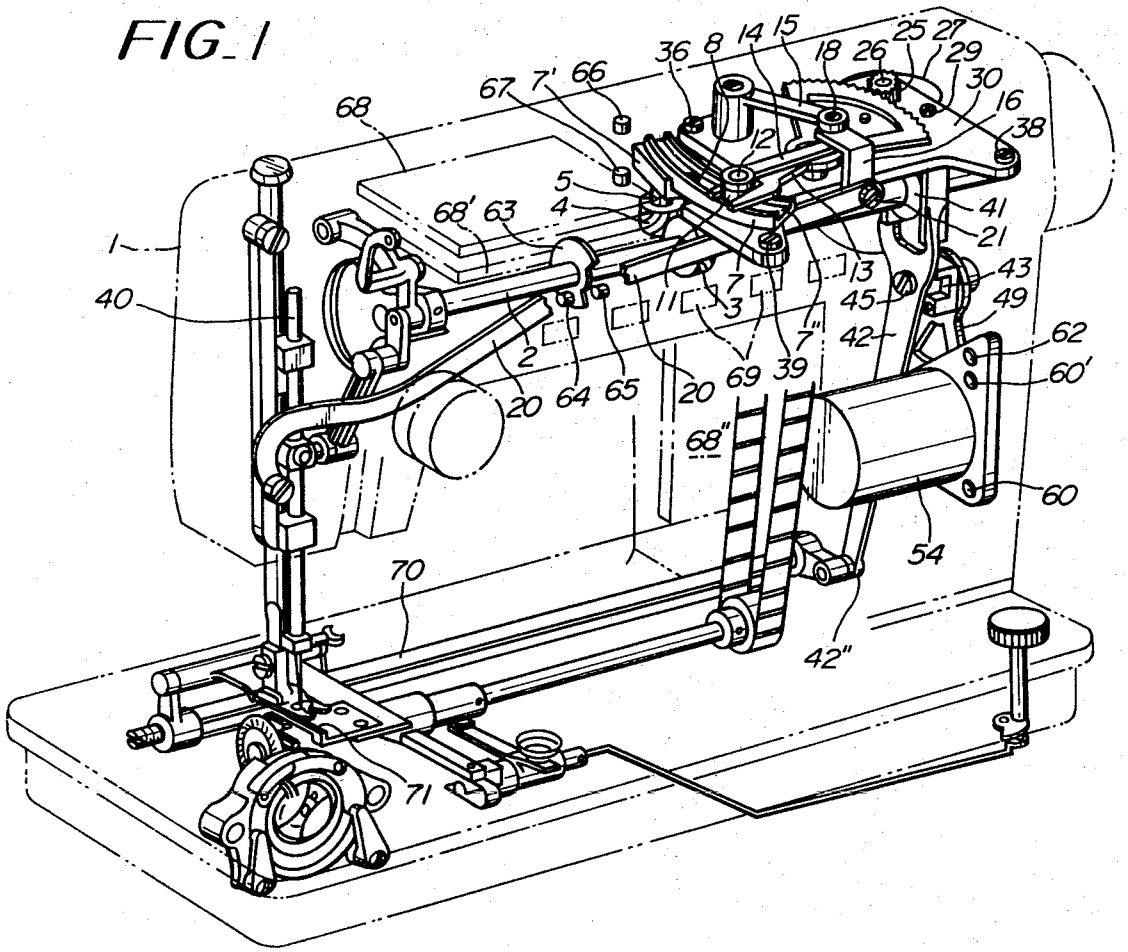

The present invention will be explained with reference to the accompanying drawings. Regarding a needle bar control mechanism(80) in FIG. 1, reference numeral (1) is the housing of a sewing machine, (2) is an upper shaft, (3)–(39) represent a zigzag amplitude controlling apparatus of a needle bar mechanism. (41)–(62) represent a feed control apparatus which will be explained in FIGS. 4 and 5, in which the output from a fork rod (42) is given to a feed dog(71) in FIG. 1 via a feed adjusting rod (70). A luminous diode(64) and a phototransistor(65) are fixedly mounted on a part of the machine housing in oppositely spaced positions so that a light from the luminous diode is intercepted by a disk(63) which is fixedly mounted on the upper shaft(2) and has a notch of about 180° with respect to a position of a needle bar(40) having a needle at the lower part thereof whereby logical values are predetermined as 0 or 1 in synchronism with each rotation of the upper shaft(2) of the sewing machine to give an output of rectangular waves which are equal time sequence. Another combination of a luminous diode(66) and a phototransistor(67) so arranged that light from the luminous diode(66) is intercepted by a part, e.g. a swingable part(7) during the movement of about 180° thereof which moves one cycle in two rotations of the upper shaft(2), whereby logical values are 0 to 1 in ½ cycle of the case of the combination of the luminous diode(64) and the photo-transistor, to give an output of rectangular wave being equal in the time sequence. (68)(68')(68'') are electronic control circuit apparatuses which respectively accomodate the main parts of the control circuits shown in FIGS. 10 and 11. Numeral(69) shows a plurality of pattern selecting switches operated by the machine operator.

Figure 2:
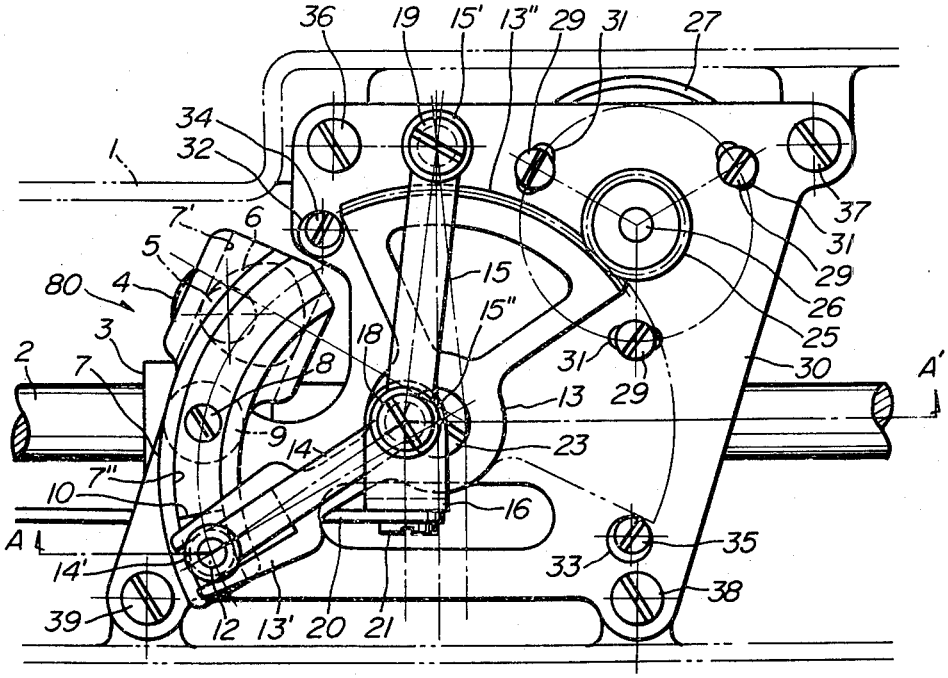
FIG. 2 is a plan view showing a part of this invention.
Figure 3:
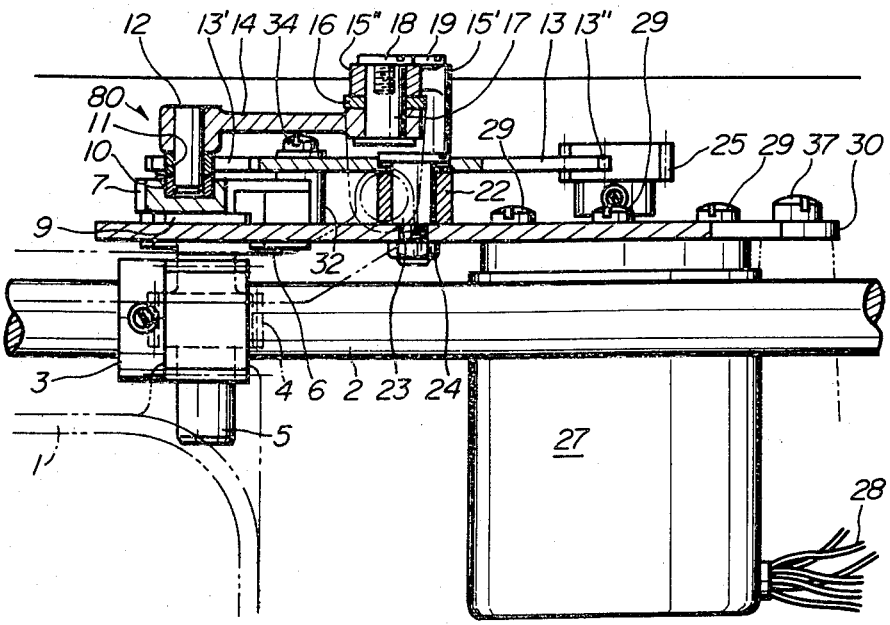
FIG. 3 is a vertical cross section taken along the line A—A of FIG. 2.

Regarding a needle bar jogging control apparatus in FIGS. 2 and 3, a worm(3) fixed to the upper shaft(2) is meshed with a worm wheel(4) which is rotatably mounted on a cam shaft(5) secured to the machine housing(1), and is made integral with a needle bar swinging cam(6) of plastic material, so that this worm(3) drives the needle bar swinging cam(6) at the speed reduced in a half of the rotation speed of the upper shaft(2). A swinging member(7) is swingably mounted on a base plate(30) by means of a shaft(8) and a spacer(9) at the center of the swinging member(7). A groove(7') on the underside of the swinging member(7) at one end part thereof is engaged by the cam(6) which swings the member(7) around the shaft(8). A block element(10) is slidably engaged in an arcuate groove(7″) formed in the upper surface of the member(7). The block element(10) and another element(11) are turnably engaged around a pin(12) which is fixedly mounted at the free end(14′) of a link(14). A swing amplitude adjusting arm(13) is turnably mounted at its center around a stepped screw(23) which is threaded into the base plate(30) and fastened by a nut(24) with an intermediate bushing(22). The swing amplitude adjusting arm(13) is at its one end formed with a fork(13′) to slidably engage the element (11), and is at the other end formed with a segmentary rack(13″) to engagea pinion(25) secured to a shaft(26) of a pulse motor (27) which is fixed to the base plate(30) on the underside thereof screws(29). A swing arm(15) shown in FIGS. 1 and 2 is at one end(15′) turnably mounted on a pivot(19) on the base plate (30). As shown in FIGS. 1 and 3, a central pivot shaft(19) and a fastening screw(18) connects the other end(15″) of the swing arm(13), the other end of the aforementioned link(14) and one end of another link(16), the other end of which is connected by a stepped screw(21) to one end of the swing rod(20), the other end of which is connected to a needle bar swing frame as shown.

In the above mentioned mechanism, control signals from the electronic control circuit apparatuses(68)(68′)(68″) shown in FIG. 1 are applied to the pulse or stepper motor(27) through the leads (28) from the pulse generating device consisting of the swing member(7), luminous diode(66) and the photo-transistor(67) to determine the needle position co-ordinates when the needle bar (40) is positioned at the vicinity of the upper dead point thereof. The pulse motor(27) is driven by a control signal to turn the swing amplitude adjusting arm(13), and selects a position of the block(10) within the arcuate groove(7″) of the swing member(7). On the other hand, the swing member(7) is swingingly moved by the cam(6) to give swinging movements to the needle bar when the needle is above the needle plate. As a result, the swing rod (20) is swung in an amplitude in proportion to the distance of the block element(10) from the swinging center(8) of the swing member(7), and the needle position coordinate of the needle bar mechanism(40) is determined.

Figure 9:
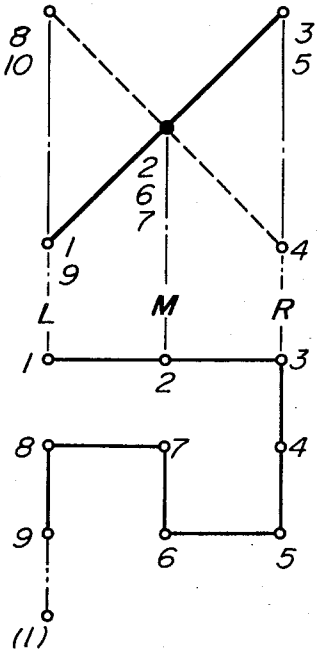
FIGS. 6–9 show stitches provided by this invention by way of example.
Figure 8:
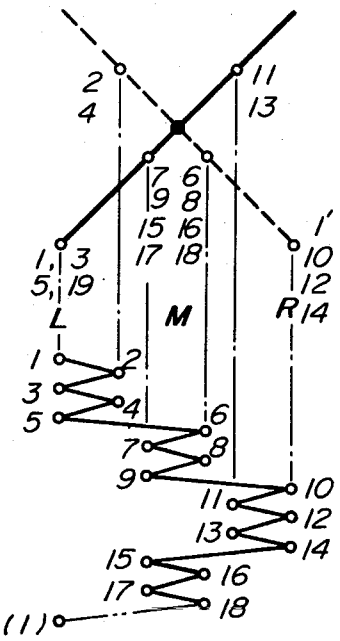
Figure 7:
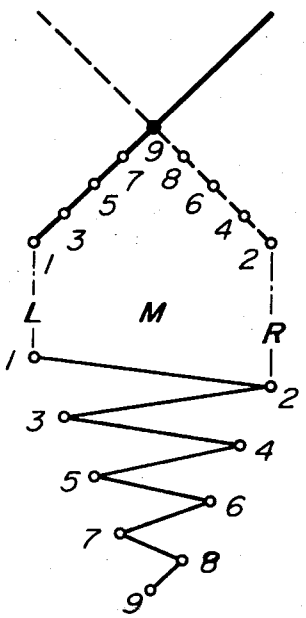
Figure 6:
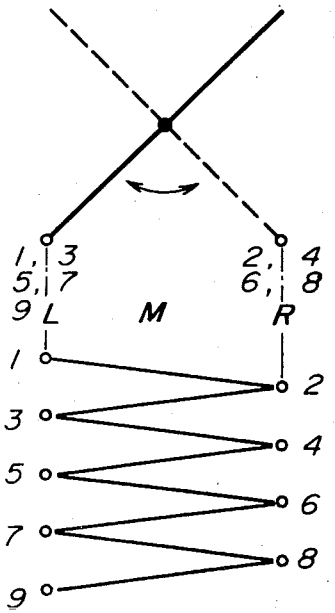

FIGS. 6–9 show that various patterns are formed by the relation between the swinging movement of the swing member(7) and the position of the block element(10), where numerals 1,2, 3, . . . designate the ordered positions of the block element(10), and the corresponding positions of the needle, and (L), (M) and (R) designate the three reference positions of left, center and right of the stitch co-ordinates. FIG. 6 shows that a zigzag pattern is obtained with the movement of the swing member(7) with the condition that a position of the block element(10) is fixed. FIG. 7 shows a pattern obtained by shifting the position of the block element(10) towards the swinging center(8) of the swing member(7) in two complete rotations of the upper shaft(2) (in one complete swinging movement of the swing member(7)). FIGS. 8 and 9 show that more complicated patterns can be obtained in this invention. In FIG. 8, the pulse motor(27) is reversely rotated to locate the block element(10) at a position(1′) as a start point of sewing, and thus the swinging movements of the swing member(7) cause the needle to form a pattern which is turned over around the reference needle position(M) to the reference needle position(R). The formation of the pattern in FIG. 9 will be described in relation with the following explanation of the feeding mechanism.

Figure 4:
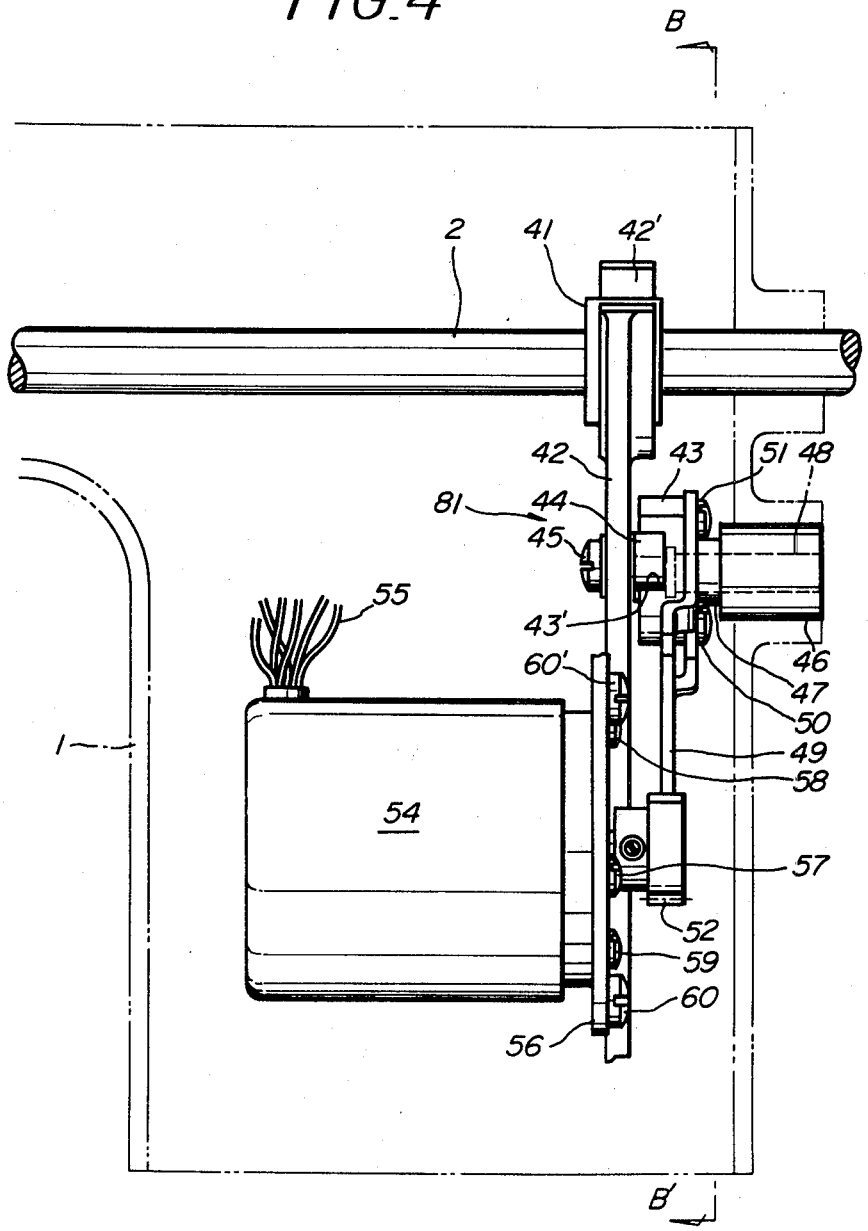
FIG. 4 is a front elevational view of another part of this invention.
Figure 5:
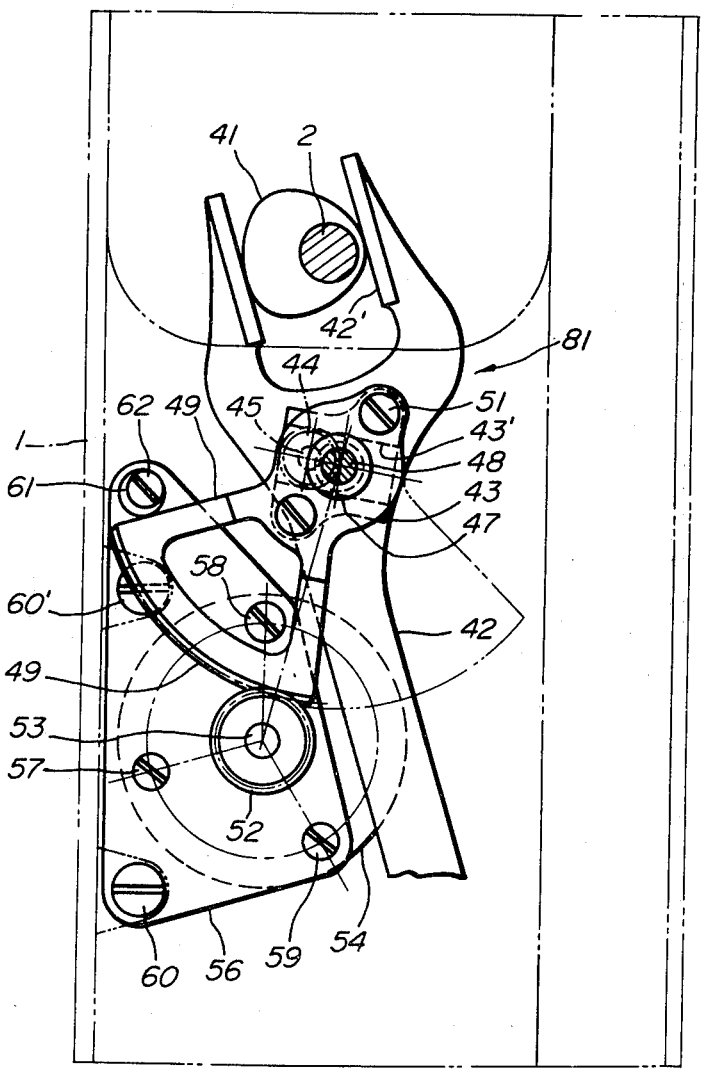
FIG. 5 is a side elevational view taken along the line B—B of FIG. 4.

Regarding a feed control mechanism(81) shown in FIGS. 4 and 5, a feeding cam(2) is secured to the upper shaft(41), a fork rod(42) is at the upper forked end(42′) engages the feeding cam(41) and is at the lower end(42″) connected the rocking rod(70) as shown in FIG. 1. On one side of the fork rod (42), a block element(44) is turnably mounted by means of a pivot(45). A feed adjusting member(43) is turnably mounted on a shaft(48) which is secured in a bushing(46) which is formed with a collar(47) and is fitted into the housing(1). The feed adjusting member(43) is formed with a groove(43′) as shown and the block element(44) on the fork rod(42) is slidably fitted into the groove(43′). The segmented member(49) is connected to the feed adjusting member(43) by means of screws(50, 51), the segmented member is formed with a rack at the segmented edge thereof. The rack of the member(49) is meshed with a pinion (52) on a motor shaft(53) of a pulse motor(54) which is secured to a plate(56) by means of screws(57)(58)(59). The plate(56) is secured to the machine housing(1) by means of screws(60,61). The rotation of the feeding cam(41) gives oscilations to the fork rod(42), and the oscillator movement of the fork rod(42) is regulated by the block element(44) which slides in the groove(43′) of the feed adjusting member(43) in accordance with the angular position of the groove (43′). The angular position of the groove (43′) is changed when a signal from the electronic control circuit apparatuses(68)(68′)(68″) is applied to the pulse or stepper motor(54) through the leads(55) to drive the same for determining a feed position co-ordinate. Thus, the oscillation of the fork rod(42) is transmitted to the rocking shaft(70) which is operatively connected to the feed dog. Namely by changing and adjusting the inclination of the groove(43′), the feeding amplitude is varied in the forward and rearward directions. With the combination of the needle bar control apparatus and the feed control apparatus, the pattern as shown in FIG. 9 can be obtained.

Figure 10:
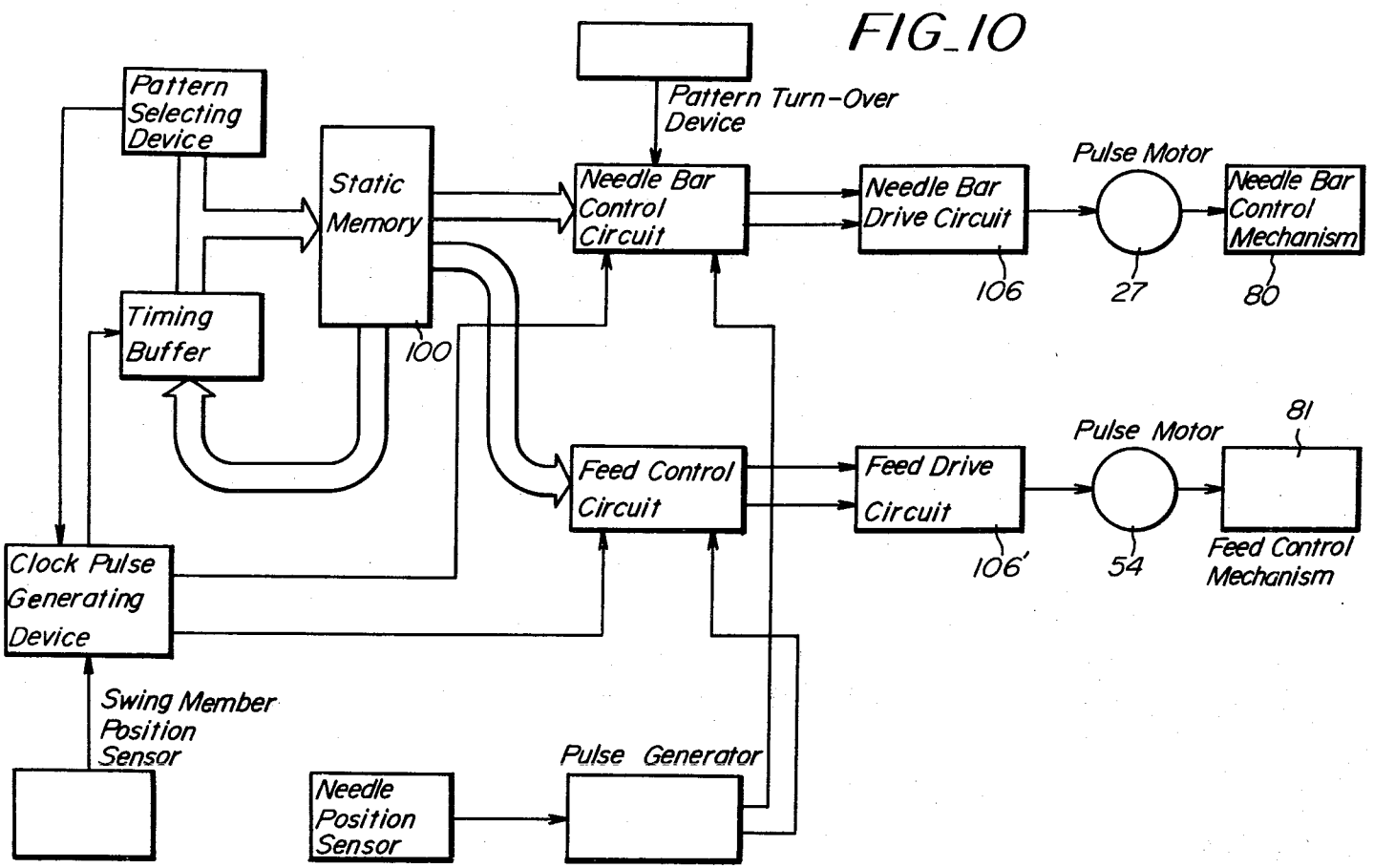
FIG. 10 is a combination of the basic constituents of the stitch control circuits of this invention, and FIG. 11A and B is block diagram of the control circuits according to this invention.

Regarding a block diagram of the electronic control circuit of the sewing machine of this invention in FIG. 10, a static memory(100) memorizes stitch control signals for effectively operating the pulse motors(27)(54-)and address changing signals for changing the addresses of the static memory per rotation of the upper shaft(2) of the sewing machine through a timing buffer. The static memory receives a signal from a manually operated pattern selecting apparatus as a first address, and gives a needle bar control circuit and a feed control circuit a stitch control signal, which is paired with the first address and designates an initial stitch co-ordinate. The static memory simultaneously gives to a timing buffer an address changing signal for selecting a second stitch coordinate. The timing buffer, upon receiving a signal from a position detector for the swing member(7) including the photo-transistor(67), which is synchronized with the rotation of the upper shaft(2) of the sewing machine, writes the address changing signal from the static memory(100) and gives this signal to the static memory, and holds the signal until it (timing buffer) receives the next synchronized signal. Thus the first address changing signal from the static memory becomes a second address to the static memory. Then the static memory gives to the needle bar control circuit and the feed control circuit a signal which is paired with the address and designates a second stitching co-ordinate. Simultaneously the static memory gives to the timing buffer an address changing signal for selecting a third stitching co-ordinate. Subsequently a new stitching co-ordinate is designated per rotation of the upper shaft(2) of the sewing machine, and a control signal corresponding the stitching co-ordinate is issued from the needle bar control circuit and from the feed control circuit to a needle bar drive circuit(106) and to a feed drive circuit(106') respectively. Thus the static memory issues the stitch control signals in succession. When a final address is issued from the static memory to give the needle bar control circuit and the feed control circuit a signal designating a final stitch co-ordinate, an address changing signal is simultaneously issued from the static memory to the timing buffer to repeatedly select the first stitching co-ordinate, so that a selected pattern is repeatedly sewn.

A clock pulse generating device is set by a signal from the pattern selecting divice, and gives the timing buffer a pulse signal which is synchronized with a signal from a swing member position sensor ao as to enable the timing buffer to change the address of the static memory in each rotation of the upper shaft(2) of the sewing machine as mentioned. The clock pulse generating device also gives the needle bar control circuit and the feed control signal for returning the pulse motors(27,54) to the reset positions in the stitching operation after the pattern has been selected. The needle bar control circuit and the feed control circuit respectively receive pulses in succession from a pulse generator and respectively give a Needle bar drive circuit(106) and a feed drive circuit(106') a signal corresponding a first stitching signal from the static memory. The subsequent stitching signals are issued in such a manner that, as aforementioned, the static memory receives the synchronized signals from the swing member position sensor and is addressed in succession and that simultaneously the needle bar control circuit and the feed control circuit receive the synchronized signals and make the signals from the static memory effective to the needle bar drive circuit and the feed drive circuit respectively. Simultaneously the pulse generator receives the signals from a needle position sensor including the aforementioned luminous diode(64) and the photo-transistor (65) and gives the needle bar control circuit successive pulses for the purpose of driving the pulse motor(27) in one half region of rotation angle 180° of the upper shaft(2) when the needle of the needle bar is located above the needle plate. Simultaneously the pulse generator gives the feed control circuit successive pulses for the purpose of driving the pulse motor(54) in the other half region of rotation angle 180° of the upper shaft(2) so that the stitch control signals to the feed control circuit from the static memory may be effective in a delayed relation (about rotation angle 180° of the upper shaft) to the stitch control signals to the needle bar control circuit.

The needle bar drive circuit(106) receives data from the needle bar control circuit and gives the pulse motor (27) an electric current to drive the same. The feed drive circuit(106') receives data from the feed control circuit and gives the pulse motor(54) an electric current to drive the same. Thus the pulse motors (27,54) control the operations of the needle bar control mechanism(80) and the feed control mechanism (81) respectively.

A pattern turn-over device is provided with a switch which is, when manually pushed, operated to drive the pulse motors(27,54) in the reverse direction. so that the pattern may be made in a form turned over around the center reference needle position(M).

FIGS. 11-A and 11-B show a more detail representation of the block diagram in FIG. 10, in which the pattern selecting device consists substantially of pattern selecting switches(69), a diode matrix(DM) and a latch circuit($L_1$). When any one of the switches ($SW_1$–$SW_7$) is closed, it gives the output terminals ($A_1$, $A_2$, $A_3$) encoded binary numbers and selects one of the seven codes including 000 and excluding 111. The output terminals ($A_1$, $A_2$, $A_3$) are connected to the input terminals of NAND circuit (NAND 1) and are also connected to the input terminals ($a_0$)($a_1$) ($a_2$) of a latch circuit($L_1$). The out put terminal of NAND circuit (NAND 1) is connected to the input terminal(IN) of a monstable multivibrator(MM 1). The true side output terminal(Q) is connected to the trigger terminal($C_p$) of a latch circuit($L_1$) and is also connected to the input terminal(IN) of a delay circuit(TD) and to one of the input terminals of AND circuit ($AND_1$). The complement side output terminal(Q) is connected to one of the input terminals of NAND circuit(NAND 2). The true side output terminal(Q) of the delay circuit(TD) is connected to one of the inputs of AND-OR circuit(AND-$OR_1$), which is paired with the other one receiving output($B_0$) of the latch circuit($L_1$), and is also connected to the other input terminal of NAND circuit(NAND 2). The complement side input terminal(Q) of the circuit(TD) is connected to another one of inputs of AND-OR circuit(AND-$OR_1$), which is paired with the other one receiving an output($E_5$) of a latch circuit($L_2$), and is also connected to the other input terminal of AND circuit($AND_1$). The output of AND circuit($AND_1$) is connected to a reset terminal (R) of the latch circuit($L_2$). The photo-transistor(67) is at its emitter connected to the ground and is at its collector connected to the input terminals(IN) of the monostable multivibrators(MM2)(MM3), and the base thereof receives light from the luminous diode(66) and gives a signal to each of the terminals (IN) in synchronism with the swinging movement of the swing member (7). (Vcc) is a D.C. power source for the control circuit, and ($R_3$) and ($R_4$)($R_1$) and ($R_2$) also are the ordinary control resistors.

The main element of the clock pulse generating device consists of the monostable multivibrators (MM2)(MM3) and D type flip-flop circuit (F/F1). The monostable multivibrator (MM2), at the rise of a signal at the input thereof, and the monostable multivibrator (MM3), at the fall of a signal at the input thereof, respectively give a positive pulse from the output (Q).

The pulse signals are transmitted to the trigger terminal ($C_p$) of the flip-flop circuit (F/F1) via OR circuit (OR1). The set terminal (S) of this circuit (F/F1) is connected to the true side output terminal (Q) of the monostable multivibrator (MM1). When a signal is given to said terminal (S), it is set, and then when the pulse signal is given to the trigger terminal ($C_p$), the true side output terminal (Q) is made, at the fall of said signal, a state of the data input terminal (D) which is connected to the ground. The true side output terminal (Q) is connected to one of the input terminals of AND circuit (And2), and the output terminal of OR circuit (OR1) is connected to the other input terminal of the AND circuit (AND2), and the output terminal of this AND circuit is connected to the input terminal (IN) of the monostable multivibrator (MM4). The monostable multivibrator (MM4) is for changing the pulse width.

The true side output terminal (Q) of the monostable multivibrator (MM4) is connected to the reset terminals (R) respectively of D type flip-flop circuits (F/F2)(F/F2') and of the presettable counters (C)(C') and to the set terminals (S) repsectively of flip-flop circuit (F/F4)(F/F4'). The complement output terminal (Q) of the flip-flop circuit (F/F1) is connected to one of the input terminals of NAND circuit (NAND), and the output terminal of OR circuit (OR1) is connected to the other input terminal of the NAND circuit. The output terminal of the NAND circuit (NAND3) is connected to one of the input terminals of NAND circuit (NAND4), and the output terminal of NAND circuit (NAND2) is connected to the other input terminal of the NAND circuit (NAND4). The output terminal of NAND circuit (NAND4) is connected to the trigger terminal $C_p$ of the latch circuit (L2). The latch circuit (L2) corresponds to the timing buffer circuit shown in FIG. 10, ($D_0$)-($D_5$) composing the address charging signals among the output terminals of the static memory (100) are respectively connected to the input terminals (d0)-(d5) of the latch circuit (L2). When a clock pulse is given to the trigger terminal ($C_p$) of the latch circuit (L2) the inputs (d0)-(d5) are respectively latched to the terminals (E0)-(E5) at the rise of the clock pulse. These outputs (E0)-(E5) are respectively connected to the address designating terminals (e0)-(e4) of the static memory (100) and the terminal (e5) thereof through AND-OR circuit (AND-OR1). (B1) and (B2) among the output terminals of the latch circuit (L1) are respectively connected to the address designating terminals (e6) (e7) of the static memory (100). These (e0)-(e7) constitute address designating signals of the static memory (100). As shown, the static memory (100) memorizes three sets of signals for one set of address designating signals (e0)-(e7). The terminals (F0)-(F5) constitute the needle bar control signals and the terminals (G0)-(G5) constitute the feed control signals, of which 5 bits (F0)-(F4) are directed to determine the rotations of the pulse motor (27), and are connected to the terminals (f0)-(f4) of the counter (C) respectively. (F5) is a bit for determining the rotating directions of the pulse motor (27), and is connected to the data input terminal (D) of the flip-flop circuit (F/F2). 5 bits (G0)-(G4) of the feed control signals (G0)-(G5) are for determining the rotations of the pulse motor (54) and are respectively connected to the terminals (g0)-(g4) of the counter (C'). (G5) is a bit for determining the rotating directions of the puse motor (54), and is connected to the data input terminal (D) of the flip-flop circuit (F/F2').

The pulse generator in FIG. 10 is composed substantially of a astable multivibrator (AM), and D type flip-flop circuit (F/F5 in FIG. 11. The astable multivibrator (AM) issues pulse signals in a very short cycle relative to the rotation cycle of the sewing machine. The output terminal of the astable multivibrator (AM) is connected to the trigger terminal ($C_p$) of the flip-flop circuit (F/F5) and to the input terminals of AND circuits (AND6)(AND7). The photo-transistor (65) is at its emitter connected to the ground and is at its collector connected to the data input terminal (D) of said flip-flop circuit (F/F5), and the base thereof receives the light from the luminous diode (64) in synchronism with the rotation of the upper shaft of the sewing machine, and gives a signal to the terminal (D). The true side output terminal (Q) and the complement side output terminal (Q) of the flip-flop circuit (F/F5) are respectively connected to the other input terminals AND circuits (AND6)(AND 7). The output terminal of (AND 6) is connected to the trigger terminal ($C_p$) of D type flip-flop circuit (F/F3) and to one input terminal of AND circuit (AND3). Similarly, the output terminal of (AND 7) is connected to the trigger terminal ($C_p$) of D type flip-flop circuit (F/F3') and to one of the input terminals of AND circuit (AND3').

The needle bar control circuit in FIG. 10 is a composed substantially of the flip-flop circuits (F/F2),(F/F3), (F/F4) and counter (C). The feed control circuit is composed substantially of the flip-flop circuits (F/F2'), (F/F3'), (F/F4') and counter (C'). The true side output terminal (Q) of the flip-flop circuit (F/F2) is connected to an input terminal of AND-OR circuit (AND-OR2), which is paired with a terminal connected to the collector of the photo-transistor (67), and the complement output terminal (Q) of the flip-flop circuit (F/F2) is connected to an input terminal of the AND-OR circuit (AND-OR2), which is paired with a terminal connected to the collector of the phototransistor (67) through an inverter (IN1). The output terminal of the AND-OR circuit is connected to one (NC) of the terminals of a switch (SW8) which is a main element of the pattern turnover apparatus shown in FIG. 10, and is also connected to the other terminal (NO) via an inverter (IN2). A movable element (C) of the switch (SW8) is connected to one input terminal of AND circuit (AND4) and is also connected to one input terminal of AND circuit (AND 5) via an inverter (IN3). The true side output terminal of the flip-flop circuit (F/F2') is connected to one of the input terminals of AND circuit (AND4'), and the complement side output terminal (Q) is connected to one of the input terminals of AND circuit (AND5').

In the following description of this invention, the feed control and the needle bar control are substantially the same in structure, and reference will be made only to the needle bar control. The counter (C) is composed of 5 bits (C4)-(C0) with a code 00001 when it is reset, and issue the codes in a predetermined order. The first code to be counted up is determined by the signals at the 5 bits (f4)-(f0) of the input terminals. Each code is counted up at each fall of a signal at the count up terminal (UP), and the count of the codes is terminated when the signals at the output terminals (C4)-(C0) become 11111. The timing at the start of count depends on the rise of a signal at the load terminal (L). The output terminals (C4)-(C0) of the counter (C) are connected to the input terminals of NAND circuit (NAND5). The output terminal of NAND circuit (NAND5) is connected to the data input terminal (D) and to the reset terminal (R) of the flip-flop circuit (F/F3), and to the trigger terminal ($C_p$) of the flip-flop circuit (F/F4). The true side output terminal (Q) of the flip-flop circuit (F/F3) is connected to the other input terminal of the AND circuit (AND3). The output terminal of the AND circuit (AND3) is connected to the count-up terminal (UP) of the counter (C) and to the other input terminals of AND circuits (AND4) (AND5) respectively. The flip-flop circuit (F/F4) has a data input terminal (D) connected to the ground and has a complement side output terminal (Q) connected to a monostable multivibrator (MM5) and the complement side output terminal (Q) of the monostable multivibrator is connected to one input terminal of NAND circuit (NAND6). The other input terminal of the NAND circuit (NAND6) is connected to the output terminal of NAND circuit (NAND3), and the output terminal of the NAND circuit (NAND6) is connected to the load terminal (L) of the counter (C) and to the trigger terminal ($C_p$) of the flip-flop circuit (F/F2). The needle bar drive circuit (106) is at its input terminal (F.P) connected to the AND circuit (AND4) to drive the pulse motor (27) in the normal direction. The needle bar drive circuit is at its input terminal (B.P) connected to the output terminal of the AND circuit (AND5) to drive the pulse motor in the inverse direction. The needle bar drive circuit is at its setting terminal (S) connected to the true side output terminal (Q) of the flip-flop circuit (F/F4). The pulse motor (27) is of three phases, and is set at the initiation of the stitching operation. When the terminals (S) and (F.P) of the needle bar drive circuit (106) receive rising signals respectively, the pulse motor (27) is energized at the phase on the side of normal rotation relative to the phase which had been energized at the time of setting. Similarly when the terminals (S) and (B.P) of the needle bar drive circuit receive rising signals respectively, the pulse motor is energized at the phase on the side of the reverse rotation relative to the phase which had been energized at the time of setting. Thus the pulse motor is driven depending upon the counts of the counter (C).

The operation of the control circuit shown in FIG. 11 will be explained. When any one of the pattern selecting switches (SW1)-(SW7) is closed, the output of the NAND circuit (NAND1) becomes 1, because one of the signals at the encoded outputs ($A_1$) ($A_2$) ($A_3$) of the diode matrix (DM) becomes 0. Therefore, the monostable multivibrator (MM1) is triggered, and then the signal at the true side (Q) triggers the latch circuit ($L_1$) to latch the signals at the outputs ($A_1$) ($A_2$) ($A_3$) of the diode matrix (DM) and give these signals to one terminal of the AND-OR circuit (AND-OR1) and to the address designating terminals ($e_6$) ($e_7$) of the static memory (100). Since the delay circuit (TD) the AND circuit (AND1) continues to give the output 1 until the delay circuit (TD) gives the output to reset the latch-circuit ($L_2$). Therefore, the outputs ($E_0$)-($E_5$) of the latch circuit ($L_2$) are all rendered 0, and the address designating terminals ($e_0$)-($e_4$) of the static memory (100) are rendered 0 directly, and the terminal (e5) is rendered 0 through the AND-OR circuit (AND-OR). In the meantime, the signals at the output terminale ($D_0$)-($D_5$) responding the signals at the terminals ($e_0$)-($e_7$) are idly changed as will be described.

As the second step, when the delay circuit (TD) gives an output after a certain period of time, the signal at the reset terminal (R) of the latch circuit (L2) becomes null, but as the NAND circuits (NAND2) (NAND3) are rendered 1, the latch circuit (L2) is in a reset condition. On the other hand, the address designating terminal (e5) of the static memory (100) receives a signal from the output (A0) of the diode dmatrix (DM) via the AND-OR circuit (AND-OR), and gives the signal of the address changing terminals (D0)-(D5), as new input signals, to the address disignating terminals (eO)-(e5) of the static memory (100) in the following step.

Namely as the third step, when the operation of the monostable multivibrator (MM1) is completed after a certain period of time, a clock pulse is given to the latch circuit (L2) via NAND circuits (NAND2) (NAND4), and then the latch circuit (L2) latches the signals at the address changing terminals (D0)-(D5)of the second step, and the signals at the terminals (D0)-(D4) are given to the address designating terminals (e0)-(e4) of the static memory (100). However, the next signals of the address changing out-puts (D0)-(D5) corresponding to the signals of the address changing terminals (e0)-(e7) are given to the latch circuit (L2), but are not latched until a new clock pulse is given.

As the fourth step, when the operation of the delay circuit (TD) is completed after a certain period of time, the address designating terminal (e5) of the static memory (100) receives a signal of the output (D5) of the static momory (100) via the latch circuit (L2) and AND-OR circuit (AND-OR1) and the signals of the outputs (D0)-(D5) responding to the signals of the address designating terminals (e0)-(e7) are issued. In other words, the signals of the outputs (D0)-(D5) of the second step determine the signals of the outputs (D0)-(D5), (F0)-(F5), (G0)-(G5) of the fourth step.

In the fourth step, the signals of the terminals (F0)-(F5) (G0)-(G5) give the first stitching signals to the subsequent control circuits and at this time the address changing signals at the terminals (D0)-(D5) designate the second addresses. The base of the phototransistor (67) becomes conductive when it receives light from the luminous diode (66) per rotation of the upper shaft of the sewing machine and causes NAND circuit (NAND3) to give a negative pulse, thereby to give a positive pulse to the latch circuit (L2) via NAND circuit (NAND4). Therefore, the signals of said address changing outputs (D0)-(D5) are successively latched to the latch circuit (L2) per rotation of the sewing machine to change and designate the stitches in succession, and the signals of the outputs (F0)-(F5). (G0)-(G5) in the second step designating the addresses in the fourth step become the last stitch control signals. Thus a pattern is repeatedly stitched.

The flip-flop circuit (F/F1) is set by the operator operating the pattern selecting apparatus (69) to render the true side output terminal (Q) 1, and when the sewing machine is rotated in succession, the AND circuit (AND2) issues a positive pulse only once at the rise or fall of the signal of the phototransistor. That is, in the following rotations of the sewing machine, the true side out-put terminal (Q) becomes 0. A pulse from the AND circuit (AND2) causes the flip-flop circuits (F/F2) (F/F2') and the counters (C) (C') to be reset and causes the flip-flop circuits (F/F4) (F/F4') to be set. In this case, if the output of the photo-transistor (67) is 1, and the movable elements (C) of the (SW8) is connected to the terminal (NC), a value 1 is given to one terminal of the AND circuit (AND5).

When the needle of the sewing machine is located above the needle plate at the start of the rotation of the sewing machine, the output of the photo-transistor (65) is 1. During this period of time, pulses are supplied relatively in a short cycle to the trigger terminal ($C_p$) of the flip-flop circuit (F/F3) from the astable multivibrator (AM) via AND circuit (AND6). Since the output signals at the terminals ($C_4$)-(C0) of the counter (C) are rendered 00001 (C0 only is turned to 1 and the others are 0) as it was reset, the data input terminal (D) of the flip-flop circuit (F/F3) receives a value 1, and subsequently the true side output terminal (Q) is rendered 1 at the fall of the signal at the trigger terminal ($C_p$), and the pulse of the astable multivibrator (AM) is given to the other input terminal of the NAND circuit (AND5) through the AND circuit (AND3). The pulse motor (27) is rotated in the reverse direction by the needle bar drive circuit (106) in a speed in accordance to the pulse. Namely the counter (C) counts up at the fall of a signal at the count-up terminal (UP) each time when the AND circuit (AND5) receives the signal from the astable multivibrator (AM). When the output terminals ($C_4$)–(C0) become 11111, the value at the NAND circuit (NAND5) becomes 0 to reset the flip-flop circuit (F/F3). In the meantime, the pulse motor (27) is driven in accordance to the count up (30 in this case) of the counter (C) to set the needle bar (40) to a mechanical value, for example, to the reference needle position (L) at the start of stitching operation.

When the value at the NAND circuit (NAND5) becomes 0, the complement side output terminal (Q) of the flip-flop circuit (F/F4) is rendered 1. Therefore the load terminal (L) of the counter (C) receives a signal from the flip-flop circuit (F/F4) through the monostable multivibrator (MM5) and the NAND circuit (NAND6), and then receives the values at the output terminals (F4)–(F0) of the static memory (100). At the same time, the subsequent falling signal is transmitted to the trigger terminal ($C_p$) of the flip-flop circuit (F/F2), so that a signal from the output terminal (F5) of the static memory (100) may be latched to the flip-flop circuit (F/F2).

Assuming that the codes of (F5)–(F0) of the static memory are determined 111101 by the operation of pattern selecting apparatus (69), the output terminal ($C_4$)–(C0) of the counter (C) become 11100, the value at the NAND circuit (NAND5) becomes 1, and output terminal (Q) of the flip-flop circuit (F/F3) is rendered 1 again by the successive pulses from the astable multivibrator (AM). When a pulse is issued from the AND circuit (AND3), the counter (C) counts up with the falling signal at the count-up terminal (UP) and renders the next code 11111 at the output terminals (C4)–(C0) to reset the flip-flop circuit (F/F3). On the other hand, since the output terminal (Q) of the flip-flop circuit (F/F2) is 1 and the value of the photo-transistor (67) is also 1, the pulse motor (27) is driven by the pulse in the normal direction.

Therefore, the pulse motor (27) moves the needle of the sewing machine to a certain predetermined position (e.g. on the reference needle position L) before the needle penetrates the sewn work on the needle plate, and the first stitch coordinate is determined relative to the reference needle position (L) by a signal of the pattern selecting device (69). This is the same with regard to the feed control. But in this case, the successive pulses from the astable multivibrator (AM) are issued through the AND circuit (AND7) in a phase different 180° of the upper shaft (2) from the case of the needle bar control.

With respect to the stitches following the first one, the falling signals each issued from the NAND circuit (NAND3) per rotation of the upper shaft (2) of the sewing machine enable the latch circuit (L2) to latch the address signals from the static memory (100), and the static memory to issue new stitching codes while the falling signals enable the counter (C) to receive the stitching codes from the static memory.

In order to turn over the patterns such as shown in FIGS. 8 and 9 around the center reference needle position (M) the movable element (C) of the switch (SW8) is shifted to the terminal (NO) from the terminal (NC) so as to transmit the signals of the AND-OR circuit (AND-OR2), which are reversed at the inverter (IN2), to the AND circuits (AND4) (AND5). Therefore, the resetting time point of the pulse motor (27) is determined by the reversed signal from the photo-transistor (67) which is in association with the swing member (7). As the result, the pulse motor (27) is reset to a position in the direction opposite to the position in which it was located before the movable element (C) was switched over, and then it is driven. Thus the patterns, which are sewn with the reference needle position (L) before the movable element (C) is switched over, will be sewn with the reference needle position (R) after the movable element (C) has been switched over.

We claim:

1. In an electrical sewing machine, in combination, a rotating drive shaft, a work-feeding unit operative for feeding a workpiece being stitched in a predetermined workpiece-feed direction, a longitudinally reciprocatable sewing needle driven by the rotating drive shaft and operative during rotation of the drive shaft for periodically penetrating into a stitched workpiece, the needle additionally being mounted for displacement in the direction transverse to the workpiece-feed direction intermediate successive penetrations of the needle into the stitched workpiece, the range of transverse displacement of the needle including a left extreme transversely displaced needle setting in which the needle can penetrate into the stitched workpiece, a right extreme transversely displaced needle setting in which the needle can penetrate into the stitched workpiece, and a middle needle setting intermediate the left and right extreme transversely displaced needle settings in which the needle likewise can penetrate into the stitched workpiece, a needle-shifting unit operative for transversely shifting the needle, the needle-shifting unit comprising motion-converting means coupled to and driven by the rotating drive shaft and operative for converting the motion of the rotating drive shaft into transverse displacement of the needle to the different needle settings, the motion-converting means including adjusting means for varying the converted motion produced by the motion-converting means, the adjusting means having a range of settings including a first setting causing the motion-converting means to so transversely displace the needle that the needle is at the left extreme needle setting during a penetration of the needle into the stitched workpiece, a second setting causing the motion-converting means to so transversely displace the needle that the needle is at the right extreme needle setting during a needle penetration, and a middle setting causing the motion-converting means to so transversely displace the needle that the needle is in the middle needle setting during a needle penetration, a stepper motor coupled to the adjusting means for changing the setting of the adjusting means, the stepper motor being controllable for changing the setting of the adjusting means such that the needle is at needle settings to the left of the middle needle setting during each of a plurality of immediately successive needle penetrations, the stepper motor being controllable for changing the setting of the adjusting means such that the needle is at needle settings to the right of the middle needle setting during each of a plurality of immediately successive needle penetrations, and the stepper motor additionally being controllable for changing the setting of the adjusting means such that the needle is alternately at needle settings to the right of the middle setting and to the left thereof during alternate ones of a plurality of immediately successive needle penetrations, an electronic memory containing information determinative of the successive settings to which the stepper motor is to move the adjusting means during the course of the sewing of a stitch pattern, means for effecting read-out of the information in the electronic memory in synchronism with the rotation of the drive shaft, and motor control circuit means receiving the information from the electronic memory and in dependence thereon controlling the stepper motor to cause the latter to move the adjusting means to the successive settings determined by the information read out from the electronic memory.

2. The sewing machine defined in claim 1, the motion-converting means comprising reciprocating-motion-generating means coupled to and driven by the rotating drive shaft and operative for generating reciprocating motion so long as the drive shaft rotates, the adjusting means comprising amplitude-adjusting means movable to a plurality of different amplitude settings each causing the reciprocating motion-generating means to continually produce reciprocating motion of a different respective amplitude for an unlimited duration so long as the drive shaft rotates.

3. In an electrical sewing machine, in combination, a rotating drive shaft, a longitudinally reciprocatable sewing needle driven by the rotating drive shaft and operative during rotation of the drive shaft for periodically penetrating into a stitched workpiece, a work-feeding unit operative for feeding a workpiece being stitched in a predetermined workpiece-feed direction, the work-feeding unit including a workpiece-engaging structure displaceable in a first direction by a variable amount to feed the stitched workpiece in the first direction by a variable amount intermediate successive penetrations of the needle into the workpiece, the workpiece-engaging structure being displaceable in an opposite second direction by a variable amount to feed the stitched workpiece in the second direction by a variable amount intermediate successive penetrations of the needle into the workpiece, the work-feeding unit comprising motion-converting means coupled to and driven by the rotating drive shaft and coupled to and driving the workpiece-engaging structure and operative for converting the rotary motion of the rotating drive shaft into displacement of the workpice-engaging structure in said workpiece-feed direction, the motion-converting means including adjusting means for varying the converted motion produced by the motion-converting means, the adjusting means having a range of settings intermediate a first extreme setting causing the motion-converting means to so displace the workpiece-engaging structure that the latter feeds the stitched workpiece in the first direction by an extreme amount intermediate successive penetrations of the needle into the workpiece and a second extreme setting causing the motion-converting means to so displace the workpiece-engaging structure that the latter feeds the stitched workpiece in the second direction by an extreme amount intermediate successive penetrations of the needle into the workpiece, a stepper motor coupled to the adjusting means for changing the setting of the adjusting means, the stepper motor being controllable for changing the setting of the adjusting means such that the workpiece-engaging structure feeds the stitched workpiece in the first direction during each of the intervals intermediate a plurality of immediately successive needle penetrations, the stepper motor being controllable for changing the setting of the adjusting means such that the workpiece-engaging structure feeds the stitched workpiece in the second direction during each of the intervals intermediate a plurality of immediately successive needle penetrations, and the stepper motor additionally being controllable for changing the setting of the adjusting means such that the workpiece-engaging structure alternately feeds the stitched workpiece in the first direction and in the second direction during alternate ones of the intervals intermediate a plurality of immediately successive needle penetrations, an electronic memory containing information determinative of the successive settings to which the stepper motor is to move the adjusting means during the course of the sewing of a stitch pattern, means for effecting read-out of the information in the electronic memory in synchronism with the rotation of the drive shaft, and motor control circuit means receiving the information from the electronic memory and in dependence thereon energizing the stepper motor to cause the latter to move the adjusting means to the successive settings determined by the information read out from the electronic memory.

4. The sewing machine defined in claim 3, the motion-converting means comprising reciprocating-motion-generating means coupled to and driven by the rotating drive shaft and operative for generating reciprocating motion so long as the drive shaft rotates, the adjusting means comprising amplitude-adjusting means movable to a plurality of different amplitude settings each causing the reciprocating motion-generating means to continually produce reciprocating motion of a different respective amplitude for an unlimited duration so long as the drive shaft rotates.

* * * * *